US005419071A

United States Patent [19]

Fatica

[11] Patent Number: 5,419,071

[45] Date of Patent: May 30, 1995

[54] BLACK POWDER DISPENSER

[76] Inventor: Kenneth J. Fatica, 938 Colony Dr., Erie, Pa. 16505

[21] Appl. No.: 243,186

[22] Filed: May 16, 1994

[51] Int. Cl.[6] ..... F41C 9/08

[52] U.S. Cl. ..... 42/90; 86/33

[58] Field of Search ..... 42/90; 86/33

[56] References Cited

U.S. PATENT DOCUMENTS

| | | | |
|---|---|---|---|
| 3,775,889 | 12/1973 | Wilburn | 42/90 |
| 3,808,939 | 4/1974 | Ashbrook | 86/28 |
| 4,157,053 | 6/1979 | von Trnkoczy | 86/33 |
| 4,289,258 | 9/1981 | Ransom | 222/308 |
| 4,295,409 | 10/1981 | Simpson | 86/31 |
| 4,466,209 | 8/1984 | Strickland et al. | 42/90 |
| 4,696,356 | 9/1987 | Ellion et al. | 177/123 |
| 4,825,913 | 4/1989 | Stott | 141/59 |
| 4,906,120 | 3/1990 | Sekiguchi et al. | 401/268 |
| 5,005,657 | 4/1991 | Ellion et al. | 177/246 |
| 5,082,148 | 1/1992 | Dunning | 222/162 |

*Primary Examiner*—Charles T. Jordan
*Assistant Examiner*—Christopher Keith Montgomery

[57] ABSTRACT

A black powder dispenser including a refillable black powder reservoir, a slidably operated charge measure having a spring restoring feature, and a dispensing spout to convey the black powder from the charge measure to a muzzle loaded or other firearm. A strap attachment is provided for field carriage and a series of various common measure sizes and dispensing nozzle sizes is provided. In alternate embodiments a single dispenser capable of loading two differing loads from a single or dual reservoirs is disclosed.

6 Claims, 3 Drawing Sheets

FIG. 3
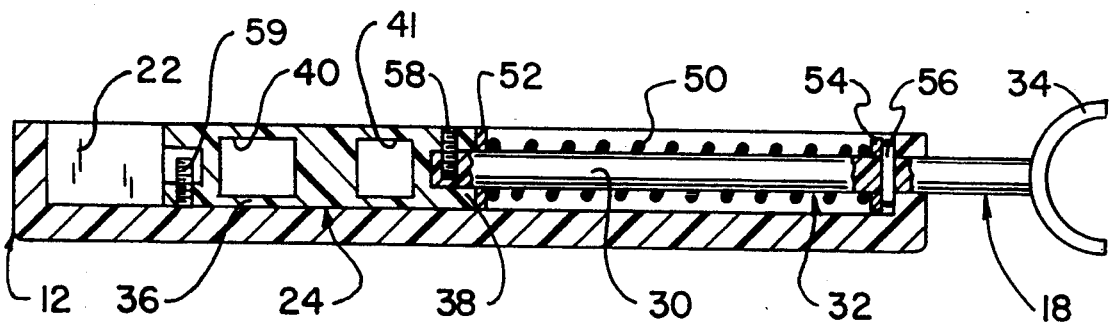
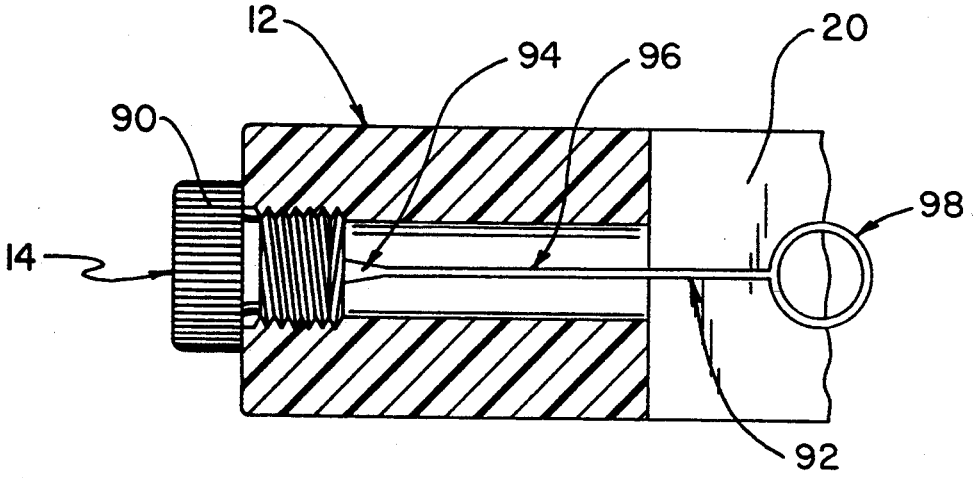
FIG. 6

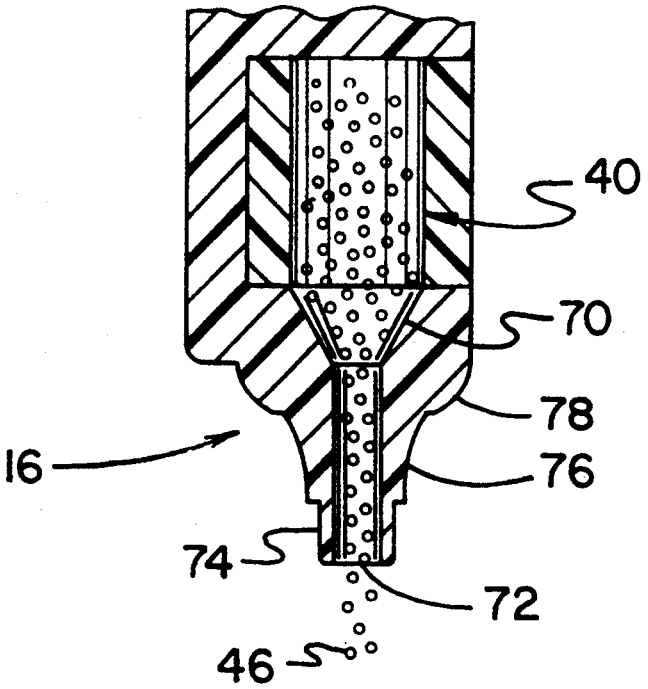
FIG. 5
FIG. 4
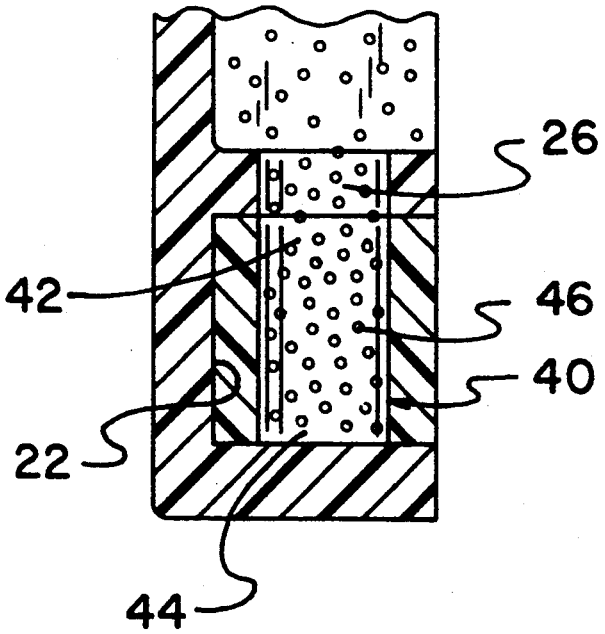

BLACK POWDER DISPENSER

BACKGROUND OF THE INVENTION

1. Field of the Invention

The present invention relates to black powder dispensers and more particularly pertains to a black powder dispenser which may be employed to incrementally load black powder gun propellant into muzzle loaders and other guns.

2. Description of the Prior Art

The use of field deployable powder measures and muzzle loader charging hardware is known in the prior art. More specifically, black powder charging hardware heretofore devised and utilized for loading black powder charged arms are known to consist basically of familiar, expected and obvious structural configurations, notwithstanding the myriad of designs encompassed by the crowded prior art which have been developed for the fulfillment of countless objectives and requirements.

The present invention is directed to improving devices for a black powder dispenser in a manner which is safe, secure, economical and aesthetically pleasing.

For example, U.S. Pat. No. 4,696,356 to Ellion et al. discloses a gun powder dispensing and measuring apparatus wherein an electrically powered motor drives a screw type conveyor to deliver measured powder charges to a powder scale. An electronic servo loop comprising a sensing means and a speed control varies the rate of powder delivery to permit accurate charge mensuration. The Ellion invention is adaptable to production scale operations involving the precision required in repetitively establishing smokeless powder factory loads, however the electrical power, precise measuring capability, and the attendant cost of the apparatus preclude casual use and more particularly render field use impractical or impossible. And furthermore, the use of screw conveyers for measuring black powder charges is strongly discourages because of a great sensitivity of black powder to frictional and electrostatic initiation. The present invention comprises a manually powered device capable of being carried on a person into field conditions for the purpose of measuring black powder charges by a cavity fill technique. The cavity fill powder measurement technique is intrinsically safer in comparison to screw conveyer approaches and yields sufficient charge weight accuracy for black powder charge measurement.

In U.S. Pat. No. 4,295,409 to Simpson a shot and powder dispenser attachment is disclosed. The Simpson invention comprises an attachment used in conjunction with shell reloading tools having a progressive dispensation of powder charge and shot as employed in the manufacture of shotgun shells. The Simpson invention is unsuitable for the field loading of black powder guns wherein shot is not used and shell reloading tools are not required. The present invention is devised to enable field reloading of muzzle loaders and related arms using black powder charges and has no requirement nor provision for loading shot or other projectiles.

In U.S. Pat. No. 5,005,657 to Ellion et al. a powder dispensing and measuring device is described. The Ellion et al. invention comprises one or more barrels transferring powder from one container to a scale and second container by vibratory assisted gravitational inducement. Electrical power is required to vibrate the barrels and an electronic servo loop is provided to measure a precise weight of powder to form each charge. The present invention is field usable and furthermore is designed to provide sufficiently accurate black powder charge weights by a volumetric, cavity fill technique. The present invention does not require electrical power for operation and needs no servo loop to control charge weight.

In U.S. Pat. No. 4,906,120 to Sekiguchi et al. a powder dispenser is described. The Sekiguchi et al. invention is devised to supply a predetermined amount of powder by finger tip operation wherein primary usage is in the cosmetics application field. The requirements for successful and safe interior ballistics for firearms preclude employment of a loosely engaging spiral powder delivery means because of a variability in charge weight resultant thereby. The present invention precisely measures charges incrementally and therefore leads to insignificant variability in charge size and interior ballistic results. And furthermore the physical differences distinguishing cosmetic powders and black gun powder generally preclude dispensing the substantially granular black gunpowder from cosmetic powder dispensers.

In U.S. Pat. No. 4,825,913 to Stott a powder dispensing apparatus is disclosed for transferring powder from a bulk supply to a container wherein a series of conduits and at least one electrically powered blower is employed. Disadvantages in this prior art lies in a lack of field portability, an inappropriate application to load black powder arms which generally comprise small filling container sizes, a requirement for electrical power, and a recognized safety hazard in employing blowers and ducts which collect black powder dust and can eventually lead to catastrophic detonation. The present invention is hand held and field transportable, and measures black powder charges for loading weapons without the use of electricity or other non-manual power sources.

U.S. Pat. No. 5,082,148 to Dunning discloses a powder dispenser. The disclosure teaches a manually powered powder dispensing system wherein a measure of substantially fine powder is dispersed into free space by an air stream. The disclosure makes no provision for measuring energetic materials such as black powder which, although termed a powder is more or less a granular substance and furthermore if dispersed by an air stream may provide a significant hazard for ignition from static electricity triboelectrically generated within the dust cloud and container walls. Furthermore, there are no provisions for loading dispensed powder within small arms. There is no teaching to refill an included powder reservoir for reuse. The present invention safely measures an amount of black powder and empties said black powder as an increment into the muzzle of small arms without the use of air streams. The present invention is designed to be refilled many times.

In this respect, the black powder dispenser according to the present invention substantially departs from the conventional concepts and designs of the prior art, and in so doing provides an apparatus primarily developed for the purpose of field measuring and dispensing black gunpowder.

Therefore, it can be appreciated that there exists a continuing need for new and improved black powder dispenser which can be carried into the field and be used to reload muzzle loading small arms under field conditions. In this regard, the present invention substantially fulfills this need.

As illustrated by the background art, efforts are continuously being made in an attempt to improve black powder dispensers and powder dispensers in general. No prior effort, however, provides the benefits attendant with the present invention. Additionally, the prior patents and commercial techniques do not suggest the present inventive combination of component elements arranged and configured as disclosed and claimed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

In view of the foregoing disadvantages inherent in the known types of powder dispensers now present in the prior art, the present invention provides an improved black powder dispenser construction wherein the same can be utilized for reloading black powder charges weapons. As such, the general purpose of the present invention, which will be described subsequently in greater detail, is to provide a new and improved black powder dispenser apparatus and method which has all the advantages of the prior art powder dispensers and none of the disadvantages.

The invention is defined by the appended claims with the specific embodiment shown in the attached drawings. For the purpose of summarizing the invention, the invention may be incorporated into a refillable reservoir portion holding a substantial supply of black gunpowder of a desirable granularity and having an exit port which engages a slide, and a dispensing nozzle. The slide has a cavity of precise volume disposed therein which when slidably positioned adjacent the exit port permits the user to fill the cavity and subsequently move the slide to a position adjacent the dispensing nozzle wherein the black powder exits as a charge increment influenced only by gravity.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In as much as the foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention as set forth in the appended claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide an improved black powder dispenser capable of producing accurately measured reloading increments of black powder charge.

It is therefore an additional object of the present invention to provide a new and improved black powder dispenser which has all the advantages of the prior art black powder dispensers and none of the disadvantages.

It is another object of the present invention to provide a new and improved black powder dispenser which may be easily and efficiently manufactured and marketed.

It is a further object of the present invention to provide a new and improved black powder dispenser which is of a durable and reliable construction.

An even further object of the present invention is to provide a new and improved black powder dispenser which is susceptible of a low cost of manufacture with regard to both materials and labor, and which accordingly is then susceptible of low prices of sale to the consuming public, thereby making such black powder dispensers economically available to the buying public.

Still yet another object of the present invention is to provide a new and improved black powder dispenser which provides in the apparatuses and methods of the prior art some of the advantages thereof, while simultaneously overcoming some of the disadvantages normally associated therewith.

Still another object of the present invention is to provide a new and improved black powder dispenser capable of being carried into the field and rendering the black gunpowder contents thereheld substantially impervious to the effects of weather.

Yet another object of the present invention is to provide a new and improved black powder dispenser wherein the incremental charge weight dispensed is substantially invariant in a charge to charge comparative analysis.

Even still another object of the present invention is to provide a new and improved black powder dispenser having provision for alternate cavity sets wherein each alternate cavity establishes a new and substantially precise black powder charge increment weight for disposition within a black powder weapon.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention. The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is sectional view of the black powder dispenser taken substantially upon the plane indicated by the section line 3—3 of FIG. 2.

FIG. 4 is a fragmentary sectional view of the black powder dispenser taken substantially upon the plane indicated by the section line 4—4 of FIG. 2.

FIG. 5 is a fragmentary sectional view of the black powder dispenser taken substantially upon the plane indicated by the section line 5—5 of FIG. 2.

FIG. 6 is a fragmentary sectional view of the black powder dispenser taken substantially upon a plane indicated by the section lines 6—6 of FIG. 2 and showing a fill port.

DESCRIPTION OF THE PREFERRED EMBODIMENT

Figure 1:
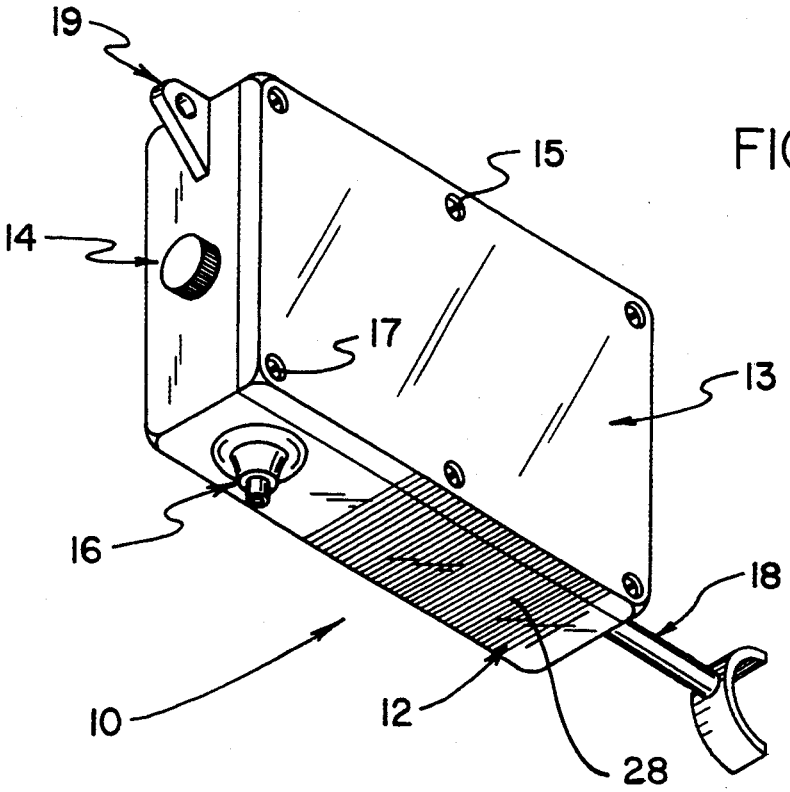
FIG. 1 is a right perspective view of the black powder dispenser showing the powder dispensing spout, fill port, and charging plunger.

With reference now to the drawings, and in particular to FIG. 1 thereof, a new and improved black powder dispenser embodying the principles and concepts of the present invention and generally designated by the reference numeral 10 will be described.

From an overview standpoint, the black powder dispenser 10 is adapted for use with black gunpowder and muzzle loading firearms to facilitate loading thereof. See FIG. 1. The black powder dispenser 10 comprises a housing 12 having a detachable cover 13 disposed thereon, a fill port 14, a powder dispensing spout 16, and a charging plunger 18. A carrying strap attachment 19 is provided to facilitate attachment to a person using a strap member for field carriage of the black powder dispenser. When operationally disposed, the black powder dispenser 10 is filled with black powder using fill port 14 and black powder is dispensed in precisely measured increments from powder dispensing spout 16 by depressing charging plunger 18.

Figure 2:
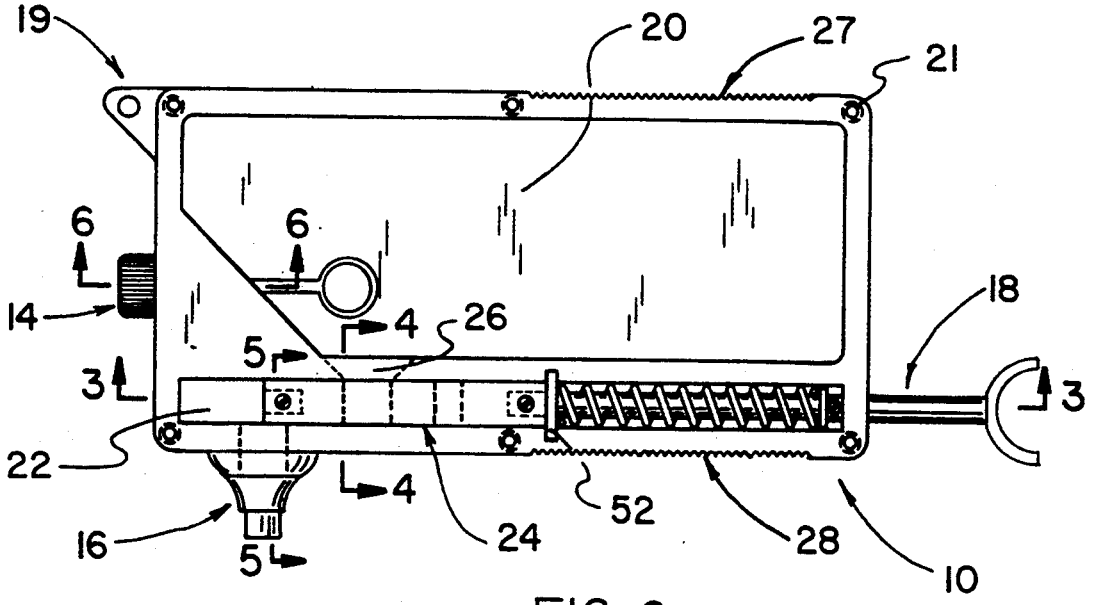
FIG. 2 is a side elevational view of the black powder dispenser with a cover removed.

More specifically, it will be noted that the black powder dispenser 10 comprises a housing 12 having therein a refillable reservoir 20, an elongated charger receiver cavity 22 having a charger 24 disposed therein, and an interconnecting passage 26. See FIG. 2. Housing 12 and cover 13 comprise a substantially optically transparent material composition such as provided by various polycarbonates and polysulfones, or a portion of housing 12 may be transparent, or housing 12 may be opaque and cover 13 may be transparent, or housing 12 and cover 13 may be substantially opaque excepting the inclusion of one or more windowed ports which are provided to enable viewing of any contents held therein. First grooved portion 27 and second grooved portion 28 are disposed upon opposing outside portions of the housing 12 and cover 13 in orthogonal disposition to charging plunger 18 thereby providing a gripping surface engaging a human hand. First and second grooved portions 27 and 28 comprise a plurality of grooves formed or cut into the housing 12 and cover 13 exterior surfaces.

In each aforementioned housing 12 or cover 13 the primary purpose of said transparent property is to provide visual indication of a quantity of black powder held therein. Secondary purposes for employing a transparent viewing port is to identify an empty condition of the black powder dispenser 10 for the purpose of storage safety, to preclude the mixing of differing granular sizes of black gunpowder, to enable a visual confirmation of the granular size of the black powder charge held therein, and to enable visual confirmation of the filling of the black powder charger 24 whenever the quantity of black powder held in reservoir 20 is minimal.

Chemical additives may be introduced within any polymeric materials employed in the construction of the black powder dispenser 10 to mitigate the hazard of accidental initiation from static electricity. And any frictionally engaging parts should be designed to minimize a potential for frictional ignition of black powder held at the part engagement site. Cover 13 comprises a substantially flat plate having a series of holes 15 which have threaded fasteners 17 passing therethrough. Cover 13 may have ribs, grooves, or gaskets or any combination thereof to provide suitable sealing properties. Threaded fasteners engage threaded holes 21 disposed upon housing 12 for the purpose of affixing cover 13 to housing 12 in a manner which prevents black powder leakage and the introduction of moisture and contaminants from the external environment from entering reservoir 20. See FIG. 3.

Charging plunger 18 comprises charger 24, rod member 30, spring assembly 32, and plunger knob 34. Charger 24 comprises a substantially rectangular solid having a first end portion 36 and a second end portion 38. First end portion 36 has a powder measuring cavity 40 centrally disposed therein. A first powder measuring cavity 40 comprises an elongated rectangularly shaped through hole having a volume which establishes a weight of a black powder charge disposed therein. A second powder measuring cavity 41 also comprises an elongated rectangularly shaped through hole having a volume which establishes a second weight of a black powder charge disposed therein. Black powder charges are measured by weight in grains and in particle size by a screen mesh passage test. For example a load for a 0.50 caliber flintlock rifle may range from eighty to one hundred grains of type FFG black powder wherein the least load yields a muzzle velocity of 1,199 feet per second and the greatest load yields 1,396 feet per second as reported in the Hodgdon Powder Data Manual. Charger 24 will load a quantity of powder contained in measuring cavity 40. An operator may load an optional powder quantity corresponding to filling measuring cavity 41 by removing charger 24, removing cover 13, loosening setscrew 58 thereby disengaging charging plunger 18, and performing a one hundred eighty degree rotation of the charger 24 thereby positioning measuring cavity 41 in an operational disposition adjacent interconnecting passage 26. After rotation, charger 24 is reattached to charging plunger 18 using setscrew 59. A series of powder measuring cavities formed as inserts, or a series of replacement chargers 24 may be made available to provide the general public with an assortment of possible resulting charge weights. Identification of the charge weight capability of each measuring cavity 40 and 41 may be embossed or otherwise clearly marked upon charger 24 and such markings are preferably positioned to be visible through the transparent housing 12 or cover 13.

In operation, charger 24 is first held by spring assembly 32 in a reset position indicated by a substantial alignment of interconnecting passage 26 and measuring cavity 40. See FIG. 4 for a showing of the charger 24 located horizontally in the lower left hand region to be left of rectangular stop 52 and extending to the charger receiver cavity 22 beneath the refillable reservoir 20 and interconnecting passage 26. In a reset position a first open end 42 of measuring cavity 40 engages interconnecting passage 26 and a second open end 44 of measuring cavity 40 engages the charger receiving cavity 22 thereby filling measuring cavity 40 with black powder 46. Spring assembly 32 comprises a helical compression spring 50 engaging fixed rectangular stop 52 at one end and load washer 54 at an end opposite. Load washer 54 is held from moving in one direction on rod member 30 by pin member 56, and furthermore movement of load washer 54 in an opposing direction is encumbered by force applied by compression spring 50. Rod member 30 is affixed to charger 24 at one end using pin member 58, and at an opposite end thereof to plunger knob 34 by a weld, threaded engagement, or other means including a monolithic structure.

Pin members 56 and 58 may comprise spring pins, taper pins, threaded setscrews, or other fastening means. A force disposed upon load washer 54 by compression spring 50 tends to maintain the charging plunger 18 in a position wherein measuring cavity 40 is aligned with interconnecting passage 26. Manually depressing charging plunger 18 by pressing plunger knob 34 causes charger 24 to slide thereby closing off interconnecting passage 26 and substantially aligning measuring cavity 40 with funnel portion 70 of powder dispensing spout 16. See FIG. 5. Funnel portion 74 terminates in a right cylindrical tube portion 72 which has an internal diameter sufficient for passage of various black powder grain sized with little impediment and clogging. Black powder granularity ranges from type FG which passes through ten mesh per inch screen but is stopped by sixteen mesh per inch screen, to FFFFG which passes through forty six mesh per inch screen and is stopped by sixty mesh per inch screen.

Black powder 46 is free to fall from the black powder dispenser 10 under the influence of gravity. Powder dispensing spout 16 comprises a tip portion 74, an intermediate portion 76, and an interface portion 78. Tip portion 74 has an outside diameter suitable for insertion within the muzzle of one or more classes of black powder firearms. Intermediate portion 76 provides an increasing diameter of dispensing spout 16. Interface portion 78 joins dispensing spout 16 to housing 12 and may comprise a single molded portion thereof or include a fastening engagement with housing 12. A first inner diameter of interface portion 78 approximates the width of the widest measuring cavity 40. Fastening engagement of interface portion 78 is achievable by threads or adhesives and detachable fastening is feasible but not generally required. Entry to refillable reservoir 20 for the purpose of filling or gross emptying of the powder charge held therein is provided by fill port 14. Fill port 14 comprises a threadedly engaging plug member 90 which sealably closes reservoir 20 thereby preventing black powder spills and, since black powder is sensitive to moisture, prevents free transfer of outside moisture to the interior of reservoir 20. An internally disposed plug retention member 92 or other means may be provided to prevent loss of plug member 90 when removed during field or other use. Plug retention member 92 comprises a plug engagement portion 94, an elongated central portion 96, and a captive ring portion 98. Plug engagement portion 94 comprises a tapering extension of plug member 90 wherein said tapering extension may be formed with plug member 90 or be affixed thereto using adhesives or an interfering engagement. Elongated central portion 96 comprises a substantially thin, flexible, rodlike member extending into reservoir 20. Captive ring portion 98 comprises a resilient ringlike form susceptible to insertion within reservoir 20 by a folded introduction thereto, and once inserted may be removed therefrom only with substantial difficulty thereby providing captivity for the plug member 90 and the plug retention member 92. The entirety of plug retention member 92 may be of similar composition to plug member 90 and furthermore may be formed as a singular unit by injection molding or casting processes.

In a first alternate embodiment, a single reservoir is centrally disposed between two oppositely disposed chargers and dispensing spouts wherein each charger has a differing charging cavity therein thereby enabling the user to select one or the other charge weight and introduce said charge weight within the firearm. For example a fifteen grain and a twenty grain charge are commonly employed in certain black powder firearms wherein the lesser charge provides less projectile muzzle velocity and range than the greater charge. The first alternate embodiment enables the user to load one or the other charge weight by introducing the appropriate dispensing spout to a vertically disposed weapon's muzzle and depressing a corresponding charging plunger.

In a second alternate embodiment, a second and additional reservoir is provided within the first alternate embodiment wherein a first reservoir exclusively supplies black powder to a first charger and dispensing spout, and a second reservoir exclusively supplies black powder to a second charger and dispensing spout, and furthermore both reservoirs are disposed between the respective chargers and dispensing spouts. The second alternate embodiment permits the user to load two charge weights as in the first alternate embodiment and furthermore the charges may differ in black powder granularity as each reservoir may be independently filled with various powder forms.

Note that throughout the foregoing discussion black powder and black gunpowder are terms defining traditional black powder being a mixture of potassium nitrate, charcoal, and sulfur; and substitute materials such as Pyrodex®, trademark of the Hodgdon Powder Company, Inc. And furthermore the terminology involving loading of a muzzle loader and muzzle loading firearms also includes the loading of black powder cartridges with the black powder dispenser 10.

And, because various single and double base smokeless gun powders are also available in substantially granular form the black powder dispenser may be adapted through changes in the powder measuring cavity dimensions, and powder dispensing spout 16 to meter incremental quantities of these powders for cartridge reloading purposes.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. In as much as the present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

What is claimed as being new and desired to be protected by LETTERS PATENT of the United States is as follows:

1. A new and improved black powder dispenser for loading increments of black gun powder into firearms or cartridges comprising:

a refillable black powder reservoir;

a slidable fixed volume charge measure having a manually selectable first filling position for filling with an incremental quantity of black powder held in said reservoir and a second charging position for emptying said incremental quantity of black powder;

a restoring means maintaining said fixed volume charge measure in the first filling position in the absence of manual stimulus;

a spout means directing said incremental quantity of black powder into a firearm or cartridge; and a housing having a multiplicity of cavitylike compartments disposed therein wherein at least one compartment comprises said black powder reservoir, a second compartment comprises a charge transfer channel which directs black powder from the reservoir to the fixed volume charge measure, and a third compartment comprises an elongated rectangular cavity engaging the fixed volume charge measure, said black powder reservoir being refillable by removal and replacement of a threadedly engaging plug member, said plug member being affixed to the housing by means of an elongated attachment means, said elongated attachment means permitting free rotation of the plug member thereby permitting removal and replacement procedure.

2. The new and improved black powder dispenser of claim 1 in which said slidable fixed volume charge measure comprises a substantially rectangular bar member having a first portion wherein a through hole of diameter requisite for holding a given quantity of a given class of black powder is disposed therein, and a second portion engaging an end of a substantially rodlike member having a knoblike member at an opposing free rodlike member end.

3. The new and improved black powder dispenser of claim 1 in which said restoring means is a spring.

4. The new and improved black powder dispenser of claim 1 in which said spout means comprises a permanently attached funnel having a first centrally disposed internal tapering hole adjoining a second centrally disposed right cylindrically walled hole wherein said tapering hole and said cylindrically walled hole share a common axis and together form a through hole of a particular size permitting passage of one or more classes of black powder therethrough.

5. The new and improved black powder dispenser of claim 4 in which said cylindrically walled hole is substantially one quarter inch in diameter.

6. A new and improved black powder dispenser for loading increments of black gun powder into firearms or cartridges comprising:

a refillable black powder reservoir;

a slidable fixed volume charge measure having a manually selectable first filling position for filling with an incremental quantity of black powder held in said reservoir and a second charging position for emptying said incremental quantity of black powder;

a restoring means maintaining said fixed volume charge measure in the first filling position in the absence of manual stimulus;

a spout means directing said incremental quantity of black powder into a firearm or cartridge; and a housing having a multiplicity of cavitylike compartments disposed therein wherein at least one compartment comprises said black powder reservoir, a second compartment comprises a charge transfer channel which directs black powder from the reservoir to the fixed volume charge measure, and a third compartment comprises an elongated rectangular cavity engaging the fixed volume charge measure, said housing comprising a body member and a lid member wherein said lid member is a substantially flattened plate affixing to said body member using a plurality of threaded fasteners.

* * * * *